United States Patent [19]

Spaanderman Cornelis

[11] Patent Number: 4,519,506

[45] Date of Patent: May 28, 1985

[54] ROTARY WEIGH-SORTER

[75] Inventor: Spaanderman Cornelis, Vlaardingen, Netherlands

[73] Assignee: Internationale Octrooi Maatschappij "Octropa" B.V., Rotterdam, Netherlands

[21] Appl. No.: 407,541

[22] Filed: Aug. 12, 1982

[30] Foreign Application Priority Data

Aug. 12, 1981 [GB] United Kingdom ..... 8124701

[51] Int. Cl.[3] ..... B07C 5/16

[52] U.S. Cl. ..... 209/592; 177/55; 177/58; 209/552

[58] Field of Search ..... 177/55, 58; 209/552, 209/555, 592, 593, 594

[56] References Cited

U.S. PATENT DOCUMENTS

| | | | |
|---|---|---|---|
| 2,158,023 | 5/1939 | Smith | 209/594 |
| 3,156,311 | 11/1964 | Olofsson | 177/55 |
| 3,339,651 | 9/1967 | Garnett | 177/55 |
| 3,477,530 | 11/1969 | Garnett | 177/55 |
| 3,613,808 | 10/1971 | Bunnelle | 209/593 X |
| 4,147,618 | 4/1979 | Richardson et al. | 209/576 X |

FOREIGN PATENT DOCUMENTS

| | | | |
|---|---|---|---|
| 593027 | 2/1934 | Fed. Rep. of Germany . | |
| 1209916 | 9/1959 | Fed. Rep. of Germany | 209/592 |
| 347166 | 4/1931 | United Kingdom . | |
| 401043 | 11/1933 | United Kingdom . | |
| 473476 | 10/1937 | United Kingdom . | |
| 504057 | 4/1939 | United Kingdom . | |
| 1246725 | 9/1971 | United Kingdom . | |

*Primary Examiner*—David A. Scherbel
*Assistant Examiner*—Glenn B. Foster
*Attorney, Agent, or Firm*—Cushman, Darby & Cushman

[57] ABSTRACT

Rotary weighsorter comprising a frame, a driving turret supported on a vertical shaft, a plurality of containers, each connected by a radial arm to the turret, a pivot connection between the arm and both the turret and the container having horizontal pivot axes, at least two weighing devices supported in the frame at different angular positions for independently weighing the containers on passing across, the weighing devices being connected to a computing device which is also connected to a motor actuating a guide cooperating with a lever attached to the containers, so that the containers may be tilted to remove articles from the containers.

1 Claim, 3 Drawing Figures

ROTARY WEIGH-SORTER

Figure 1:
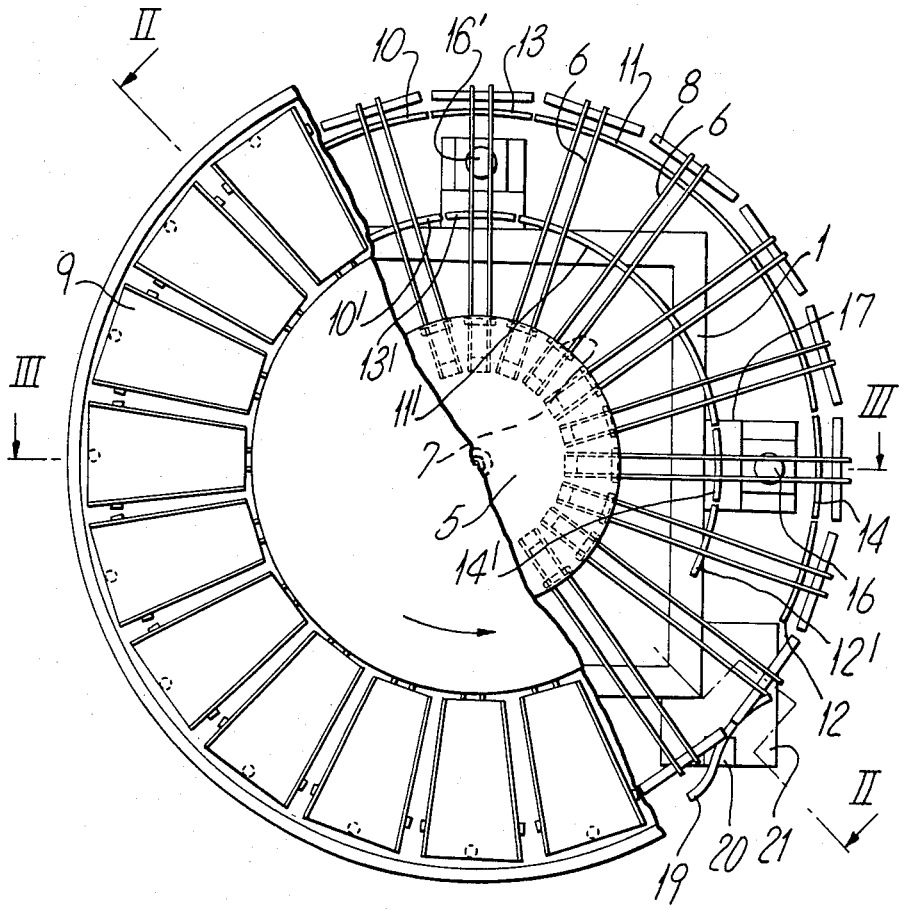

The invention relates to a device for the weighsorting of articles, particularly fish, provided with a frame, a plurality of containers for said articles, conveying means for conveying said containers across at least one weighing device along a predetermined path, a computing means for comparing the weigh data of said weighing device with data stored in said computing means and means for removing articles from the containers controlled by said computing means.

Weighsorting devices of the kind described have become known and comprise, for instance, a plurality of parallel conveyors, each provided with a separate weighing device. Said weighing devices are connected to a computing device in which the weighing data are compared with stored data and dependent thereon the first article of certain selected conveyors is removed from said conveyors.

Since each conveyor has to be provided with a weighing device and the number of possible combinations of the articles is rather restricted, a need for simpler and more widely applicable devices still exists.

The invention accordingly provides a device of the kind as described which is distinguished over those of the prior art in that each container is connected by a pivot connection having a horizontal pivot axis to one end of an arm radially extending from a driving turret about a vertical axis rotatably supported in said frame, the other end of this arm being connected with the driving turret by a pivot connection having a horizontal pivot axis and at least two separate weighing sections separately supported by load cells in the frame, the load cells each being connected to the computing means and the weighing sections being arranged at different angular positions about the turret for independently supporting and weighing separate containers.

This device only requires few, normally two, weighing devices, one for determining the tare and one for the gross weight of all containers. Since the containers are moved in a circular motion, a far larger number of combinations for selection is available. Moreover, a continuously moving device is provided which may be fed at one point.

Suitably the containers are tiltable about the outer pivot axis, creating the possibility of removing the articles by simply tilting the containers. For that purpose each container may be provided with a lever at an angle to the outer pivot axis and a guide means may be movably arranged in the frame which can be moved by computer-controlled motor means between a position extending into the path of travel of the lever and a position out of said path, the former position effecting tilting of the containers on passing.

In order to prevent reaction forces of the moving containers from being transferred to the load cells of the weighing sections, preferably both pivot axes of each arm are tangent to their path of travel about the turret.

In a reliable embodiment the containers are riding or skidding on a track which is arranged at least partly surrounding the turret, which track is in at least two places interrupted for accommodating the weighing sections.

In a simple embodiment which makes easy cleaning possible, the track is formed by two coaxial rails or rail-sequences on which the containers are skidding or riding, which rails extend at least partly around the turret at about the same level as the weighing sections.

Figure 2:
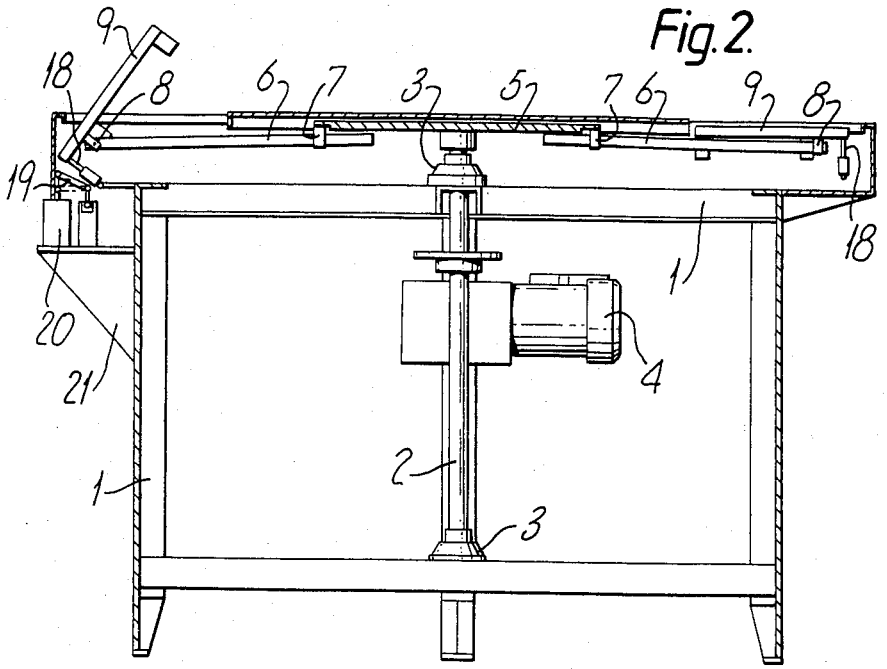
Figure 3:
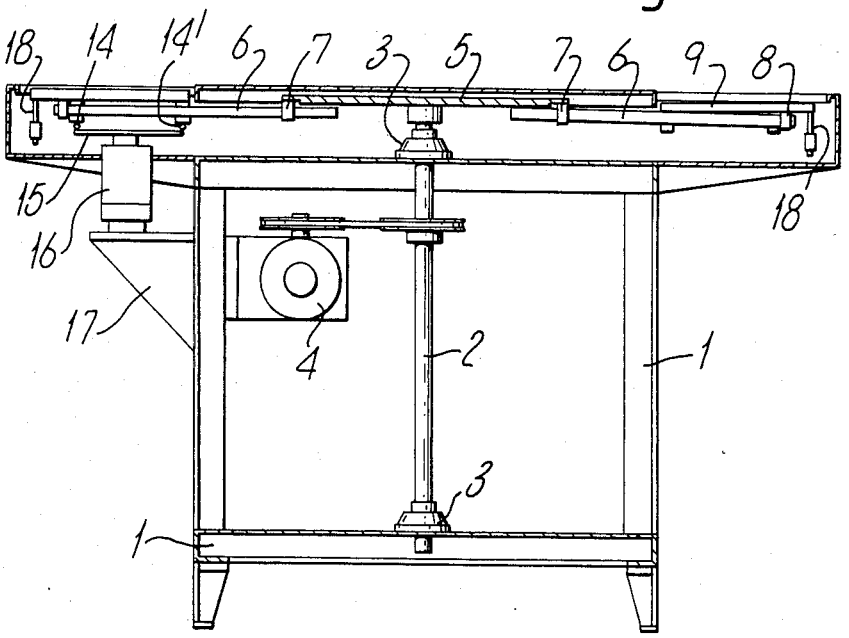

In order that the invention may be fully understood, it will now be described with reference to the accompanying drawings of a preferred embodiment in which:

FIG. 1 is a diagrammatic top view of a weighsorter of the invention, of which a number of containers and part of the turret are removed; and FIGS. 2 and 3 are vertical sections taken along the lines II—II and III—III respectively.

In a frame 1 a vertical driving shaft 2 is rotatably mounted in two bearings 3. The shaft 2 may be driven by a suitable driving motor 4 and supports at its upper extremity a turret 5, which is rotatable with the shaft.

The turret is provided with a plurality of radially extending arms 6 at equal angular intervals. The arms are each connected to the turret through a pivot connection having a horizontal pivot axis 7. The outer extremity of each arm 6 is pivotably connected to a shallow container 9 or dish through a pivot connection having a horizontal pivot axis 8.

The containers 9 are during part of their revolution around the turret 5 supported on a track formed by a series of coaxial rails 10,10',11, 11',12,12',13,13',14,14'. Some of these rails 10–12' are directly supported in the frame 1 and some, 13–14', arranged in interruptions between these fixed rails 10–12', are supported in the frame 1 by load cells 16,16' respectively. As shown in FIG. 3, the rails 14,14' are united by a support plate 15, bearing on the load cell 16, which in turn is borne by a bracket 17 supported in the frame 1.

Both load cells 16,16' are electrically connected with a computing means (not shown), which comprises comparing data and a suitable programme for selecting articles being present in the containers 9.

The computing means selects certain articles to be removed from the respective containers and activates to that end a motor means 20, moving a guide 19 into the path of travel of a lever 18 extending from the selected container, thereby forcing the lever out of its normal path and thereby tilting the container about the axis 8. The article supported on said selected container is removed and can be collected in any suitable manner. The manner in which the guide 19 and the motor means 20 are supported on a bracket 21 in the frame 1, and their functioning is best shown is FIG. 2.

The invented device can be used in different modes, dependent on the programme used in the computer, such as:

- several articles having altogether a weight between predetermined limits may be combined;
- a certain number of articles having altogether a weight just over a predetermined value may be combined;
- several groups of articles may be selected, each comprising articles having a weight between predetermined values.

I claim:

1. A device for weigh-sorting articles, such as fish, said device comprising:

- a frame having a vertical axis means rotatably supported therein;
- a driving turret attached to said vertical axis means for rotation therewith;
- a plurality of containers for said articles and a respective plurality of arms;
- each arm having a first, radially inner pivot connection pivotally connecting a respective said arm to said driving turret about a horizontal pivot axis so that the respective arm projects generally horizontally and radially outwards from said driving turret so that said arms radially outwardly of said driving turret require support from beneath in order to be kept from tilting downwards;

each arm further having a second, radially outer pivot connection pivotally connecting a respective said container to a respective said arm so that each said container is pivotable with respect to the respective said arm to which it is pivotally connected, between a first position wherein it is generally uprightly disposed to receive and contain at least one of said articles, and a second position wherein it is generally outwardly tilted for dumping therefrom at lest one of such of said articles as may be contained thereby;

at least two load cells mounted to said frame at angularly spaced locations about said driving turret;

a track means extending in a plurality of separate segments generally circumferentially about said driving turret including at least one such segment on said frame and at least another such segment respectively on each of said load cells, said track means being arranged in relation to said arms and in relation to said containers to at least indirectly support said containers as said driving turret is rotated, so that as the driving turret is rotated through a complete revolution, each said container is successively brought to bear successively upon each of said load cells;

a mechanism carried on said frame and constructed and arranged for successive interaction with said containers for temporarily tilting an article-containing said container from said first to said second position thereof for dumping at least one contained article therefrom, said mechanism being spaced angularly about said frame from said at least two load cells;

a computing means constructed and arranged for comparing container weight-related data from at least two of said load cells correlated with respective ones of sid containers in relation to successive weighings of that container by said at least two load cells in a same revolution of said power turret with data stored in said computing means relative to acceptable net weights for articles contained by said containers, and for causing said temporarily tilting mechanism to operate in regard to a weight-related determination made thereby;

said load cells being so angularly spaced from one another about said frame that a site is provided angularly therebetween at which articles may be directed into successive ones of said containers, so that as said power turret is rotated, each container is successively brought from being at least indirectly supported on said frame on said at least one segment of said track means, to being weighed in a possibly more empty condition by one of said load cells while being supported at least indirectly on a respective said other segment of said track means, to being weighed in a possibly more full condition by another of said load cells while being supported at least indirectly on another respective said other segment of said track means after passing said site, and to being brought into juxtaposition with said temporarily tilting mechanism for possible temporary tilting thereby after being weighed by said other said load cell.

* * * * *